US009334872B2

(12) United States Patent
Wark

(10) Patent No.: US 9,334,872 B2
(45) Date of Patent: May 10, 2016

(54) PORTABLE FAN

(71) Applicant: Cynthia A. Wark, Spring, TX (US)

(72) Inventor: Cynthia A. Wark, Spring, TX (US)

( * ) Notice: Subject to any disclaimer, the term of this patent is extended or adjusted under 35 U.S.C. 154(b) by 237 days.

(21) Appl. No.: 13/921,529

(22) Filed: Jun. 19, 2013

(65) Prior Publication Data

US 2014/0205479 A1 Jul. 24, 2014

Related U.S. Application Data

(60) Provisional application No. 61/756,219, filed on Jan. 24, 2013.

(51) Int. Cl.

| | |
|---|---|
| ***F04D 29/00*** | (2006.01) |
| ***F04D 25/08*** | (2006.01) |
| ***F04D 29/60*** | (2006.01) |
| ***F04D 25/06*** | (2006.01) |

(52) U.S. Cl.

CPC ..... *F04D 29/005* (2013.01); *F04D 25/0673* (2013.01); *F04D 25/084* (2013.01); *F04D 29/601* (2013.01)

(58) Field of Classification Search

CPC ..... F04D 25/08; F04D 29/60; F04D 29/601; F04D 29/602; F04D 29/64; F04D 29/644; F04D 29/646; F04D 25/0673; F04D 25/068; F04D 25/0693; F04D 29/005; F04D 29/023; F04D 29/384; F04D 29/386; F04D 29/0403; F04D 29/52

See application file for complete search history.

(56) References Cited

U.S. PATENT DOCUMENTS

| | | | | |
|---|---|---|---|---|
| 5,338,495 | A | 8/1994 | Steiner et al. | |
| 5,437,541 | A * | 8/1995 | Vainrub | 416/223 R |
| 6,422,835 | B1 * | 7/2002 | Beauchard | A47L 5/14 15/344 |
| 7,775,848 | B1 * | 8/2010 | Auerbach | 446/73 |
| 7,784,759 | B2 * | 8/2010 | Farrell | 248/315 |
| 7,984,884 | B1 * | 7/2011 | Iliev | 248/146 |
| 8,235,686 | B2 | 8/2012 | Wark | |
| 2003/0228828 | A1 * | 12/2003 | Coleman et al. | 446/236 |
| 2004/0116042 | A1 * | 6/2004 | Emoff | 446/384 |
| 2004/0165991 | A1 * | 8/2004 | Cortez | 416/244 R |
| 2006/0008353 | A1 * | 1/2006 | Wang | 416/244 R |
| 2010/0226752 | A1 * | 9/2010 | Gammack et al. | 415/90 |
| 2010/0290907 | A1 * | 11/2010 | Wark | 416/63 |
| 2012/0020065 | A1 * | 1/2012 | Opolka | 362/202 |

* cited by examiner

*Primary Examiner* — Justin Jonaitis
*Assistant Examiner* — Charles Nichols
(74) *Attorney, Agent, or Firm* — Young Basile, Hanlon & MacFarlane, P.C.

(57) ABSTRACT

A battery-powered portable personal fan is described with reference to two embodiments, both of which comprise a two-part base, of which the upper part is provided with an elongate neck to which a ball-shaped motor housing is pivotally attached. The motor housing contains a motor having a drive shaft which drives a two-blade at least 5000 RPM on a high-speed setting. In one embodiment, a rechargeable lithium ion battery is permanently mounted in the upper base portion and the lower base portion, available in multiple configurations is hollow so as to be useful as a storage area. It is preferably arranged so as to fit in one of several available golf cart cup holders. In the alternative embodiment, the lower housing is canister-shaped to receive a replaceable battery cartridge and, where desired, a tripod arrangement of legs for additional stability. Ornamental elastomeric covers can be stretched over the ball-shaped motor housing to visually link the fan to a particular sport.

3 Claims, 12 Drawing Sheets

PORTABLE FAN

CROSS-REFERENCE TO RELATED APPLICATION

This application claims the benefit of U.S. provisional patent application Ser. No. 61/756,219 filed Jan. 24, 2013.

FIELD OF THE INVENTION

This invention relates to portable battery-operated fans designed mainly for personal cooling.

BACKGROUND OF THE INVENTIONS

Most fans are designed either to create air circulation in a large area; e.g., the well-known ceiling fan, or to exhaust fumes, humidity and odor from a working or living area, the latter generally being constructed with louvers or other variable openings which operate automatically to operate when the fan is turned on and closed when the fan is turned off.

In a different category entirely is the personal fan, one example of which is described in U.S. Pat. No. 5,338,495 to Steiner et al. That patent shows a portable battery operated fan with a small motor to turn paddle-shaped blades, the fan is combined with a trigger-operated spray bottle so that an individual may create a mist of water vapor in the airstream produced by the fan. Another example is described in my U.S. Pat. No. 8,235,686; that patent describes a portable fan particularly well suited for use in golf carts having cup holders.

SUMMARY OF THE INVENTION

My objective in designing the present invention is to provide attractive, efficient and highly effective portable battery powered fans for use in connection with a broad range of personal activities from golf to personal training but also suitable in, for example, the office or home to provide effective air movement in a small area for the benefit of one or two persons.

My fan, as hereinafter described in detail, is provided in two embodiments which share certain characteristics, including quiet vibration-free operation, battery power, simple on and off and/or speed selection, aimability and versatility in the manner in which the fan base may be configured.

In a first embodiment, I provide a two-part base, the upper and lower portions of which are readily assembled or taken apart by means of, for example, threaded connection which is fully hidden when the parts are assembled. The upper base portion is configured to permanently receive and hold a high quality rechargeable battery such as a lithium-ion battery connected to, for example, a brushless DC ball bearing motor capable of rotating a lightweight, balanced two-blade impeller at both lower and higher speeds to provide personal cooling. The upper base in this embodiment is provided not only with an on/off and/or speed control switch but also a charging port which allows the battery to be recharged as necessary. With the lower base removed, the fan can be placed on a dish, table or any relatively flat surface. With the lower base portion attached, matching bezels on the upper and lower parts form a shoulder so that the fan may be placed into a conventional cup holder. Because cup holders come in several sizes, I provide a smaller diameter base and an adapter ring which fits snugly around the lower base so as to effectively increase the lower base diameter. With the adapter in place, the fan fits snugly and stably into a larger diameter cup holder. The adapter may be stored in the hollow lower base when not in use.

In another embodiment, the lower base portion is of larger capacity and configured as a canister to receive a cartridge which, in the illustrative embodiments hereinafter described, is designed to receive either six D-cell batteries in three stacks of two batteries each or a single, rechargeable battery. On the top of each cartridge are two radially-spaced spring contacts. On an inside surface of the upper base portion, generally shaped as a bezel with interior threads to capture and hold the lower base portion, are a pair of contacts that are engaged by the spring contacts for conducting power from the battery cartridge to a control switch and from there to a motor which is mounted in a swivel based fan head.

In the preferred embodiment, the fan head is ball-shaped. In addition, I propose to provide one or more elastomeric, glove-like slip-on covers for the ball-shaped head which can be used to give the head the practical and aesthetic appearance of a ball or other object selected from any of a variety of popular sports, including by way of example, baseball, volleyball and soccer.

Finally, in an illustrative embodiment hereinafter described in detail, I provide a set of three detachable legs which provide a tripod support for the base portion thereby allowing the fan to be placed in stable fashion on the smooth top of table, desk or the like.

BRIEF DESCRIPTION OF THE DRAWINGS

The various features, advantages and other uses of the present invention will become more apparent by referring to the following detailed description and drawings in which.

DETAILED DESCRIPTION OF THE ILLUSTRATIVE EMBODIMENTS

Figure 1:
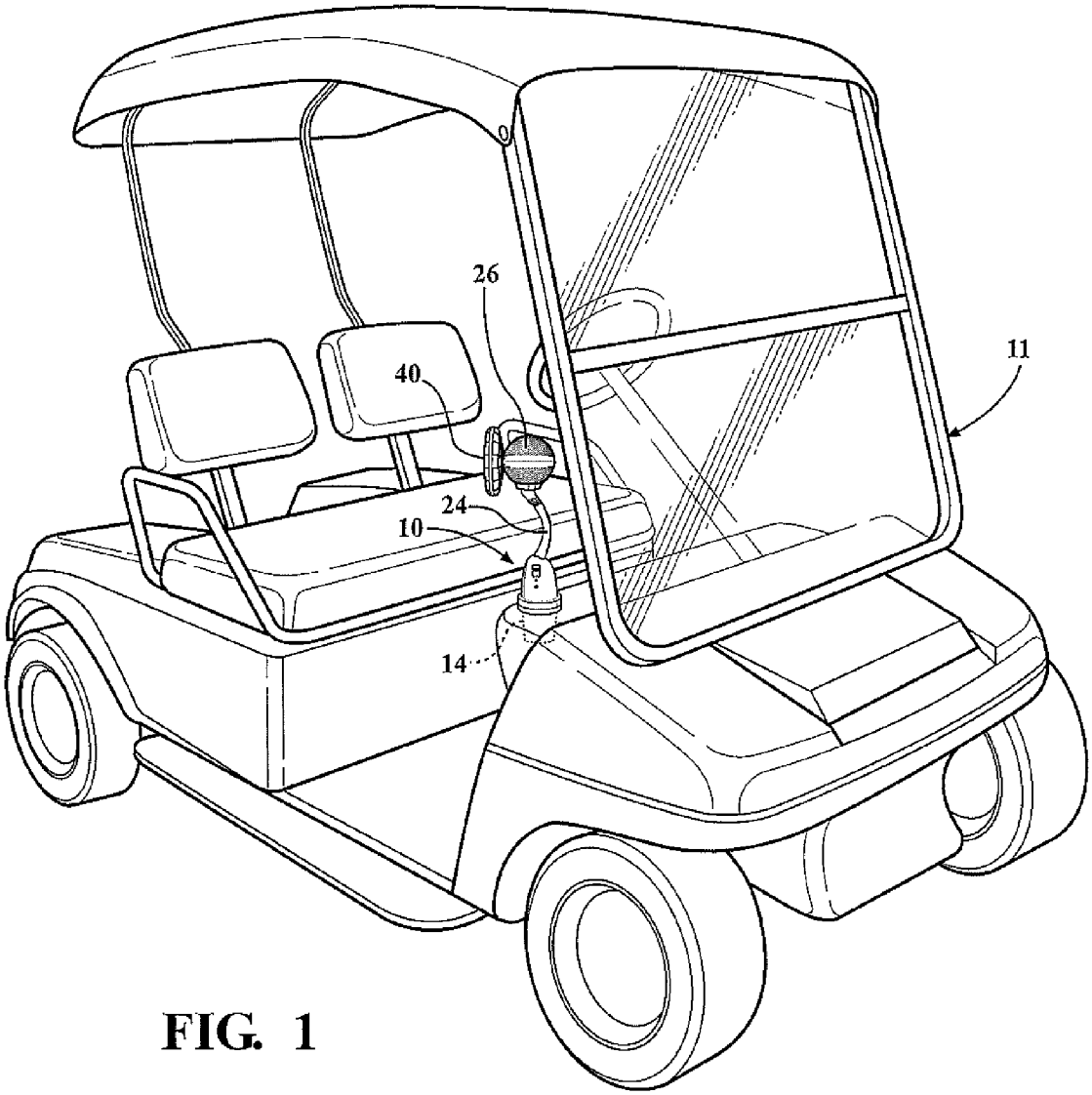
FIG. 1 is a perspective view of first embodiment of my fan used in a golf cart having cup holders.
Figure 2:
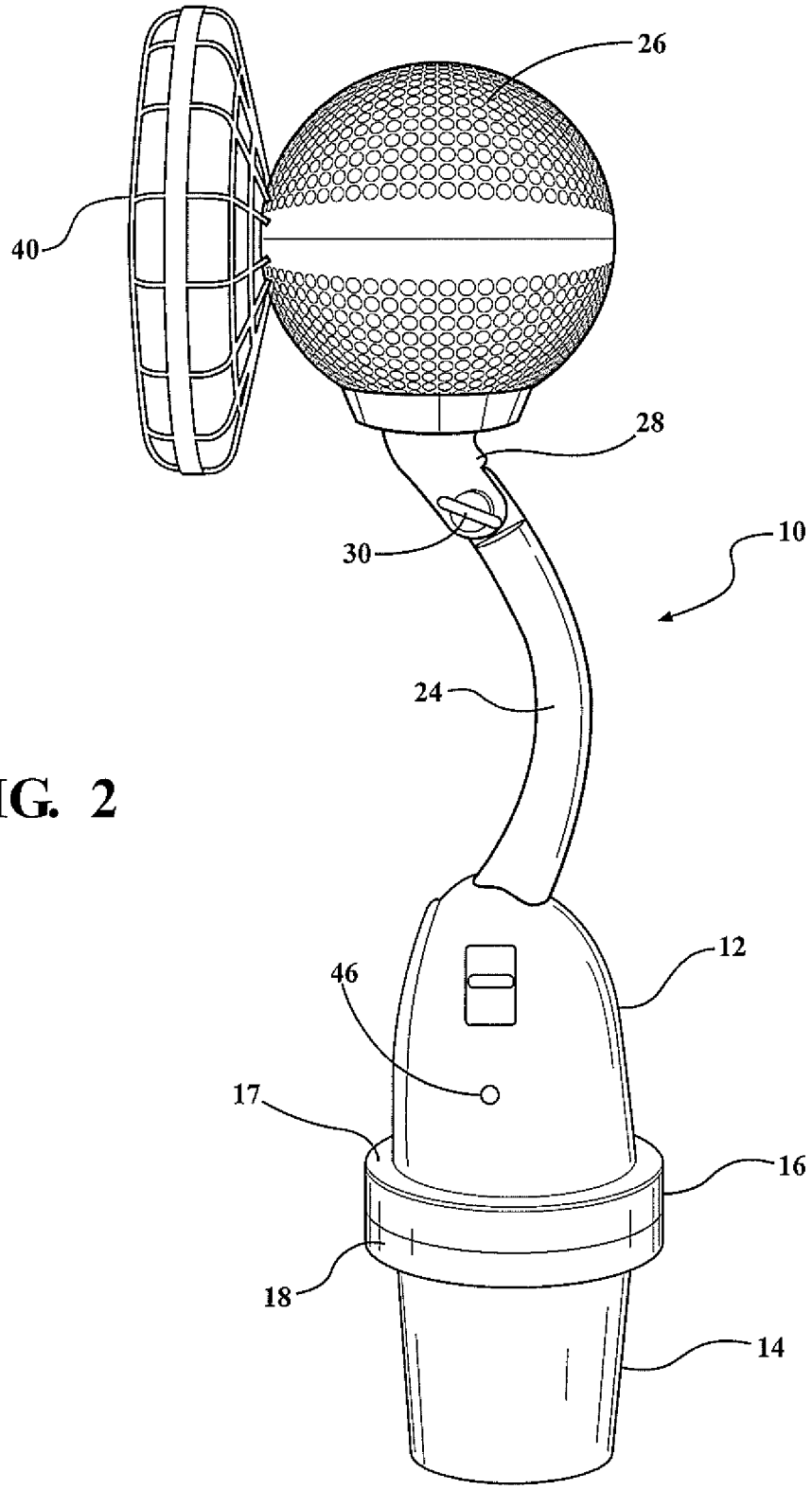
FIG. 2 is a side view in perspective of the fan of FIG. 1 showing an aesthetic cover for the ball-shaped motor housing and a two-part base suitable for placing the fan in, for example, a cup holder.
Figure 3:
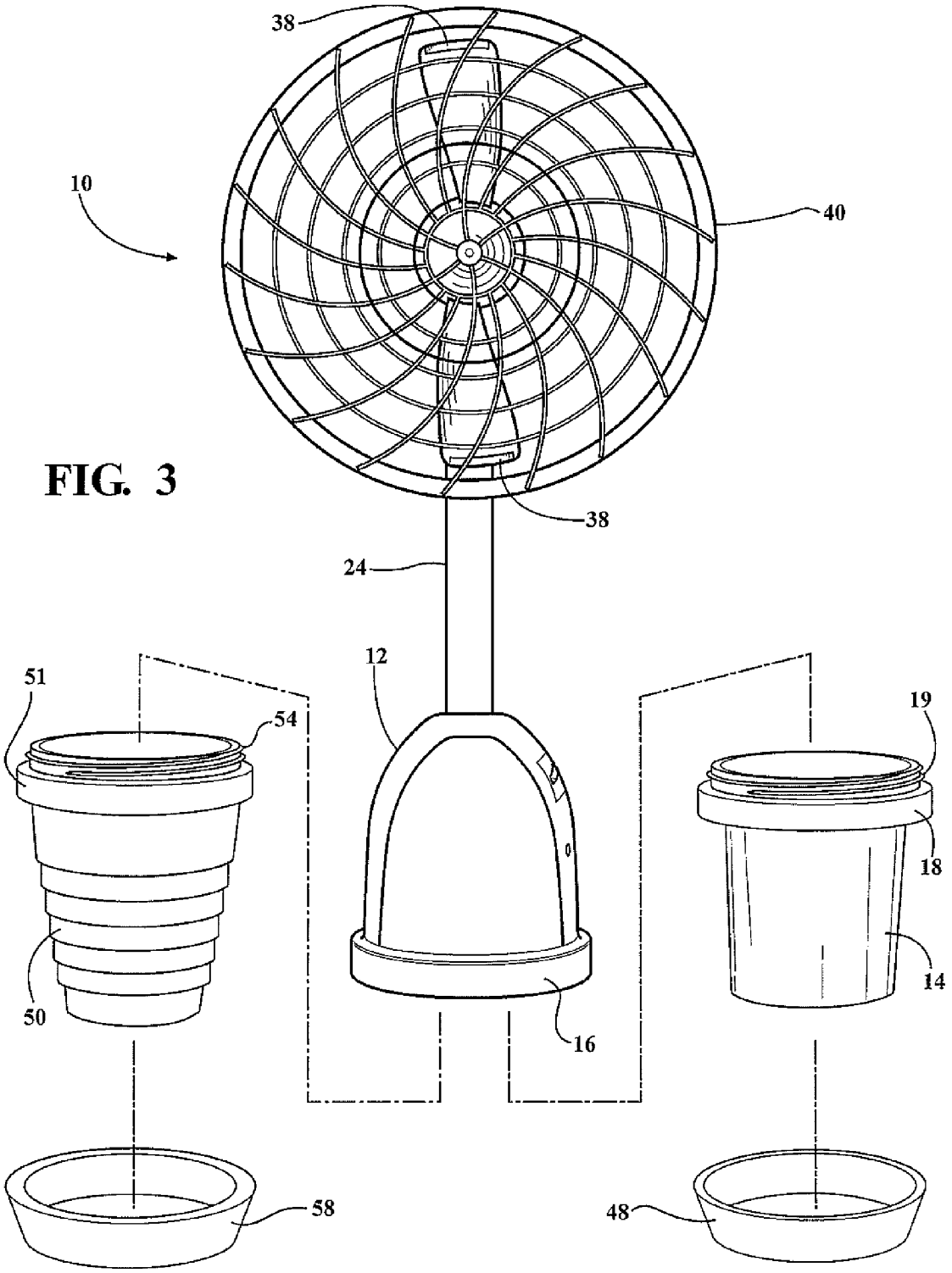
FIG. 3 is a front perspective view of the fan of FIG. 1 showing two alternative base configurations with cup holder-size adapter rings.
Figure 4:
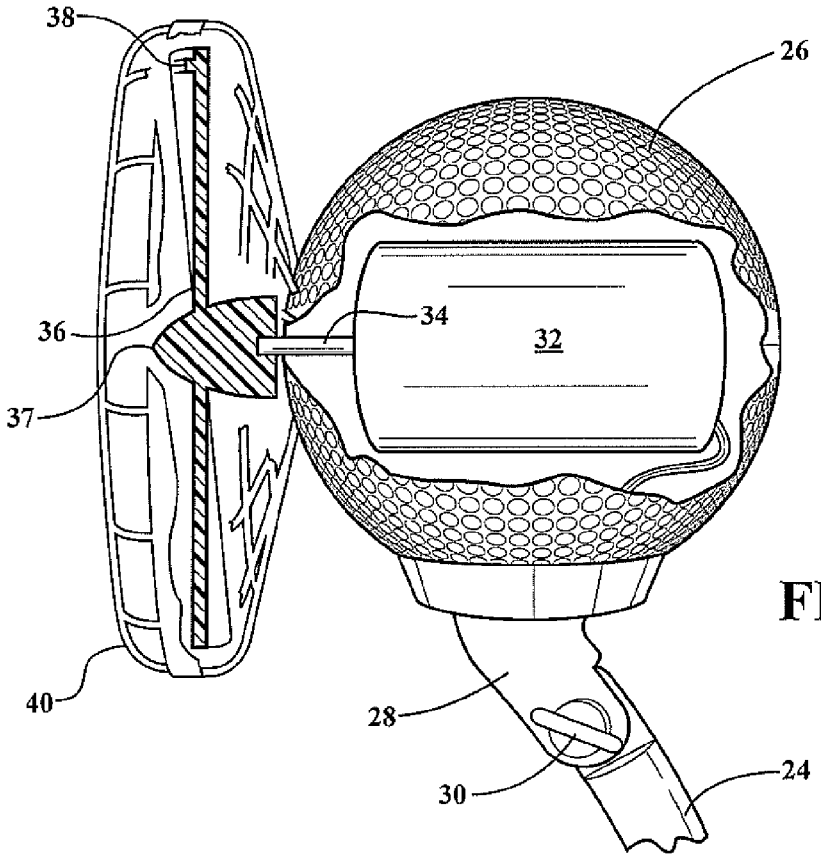
FIG. 4 is a sectional view of the upper motor housing of the embodiment of FIG. 1 broken away to show interior components.
Figure 5:
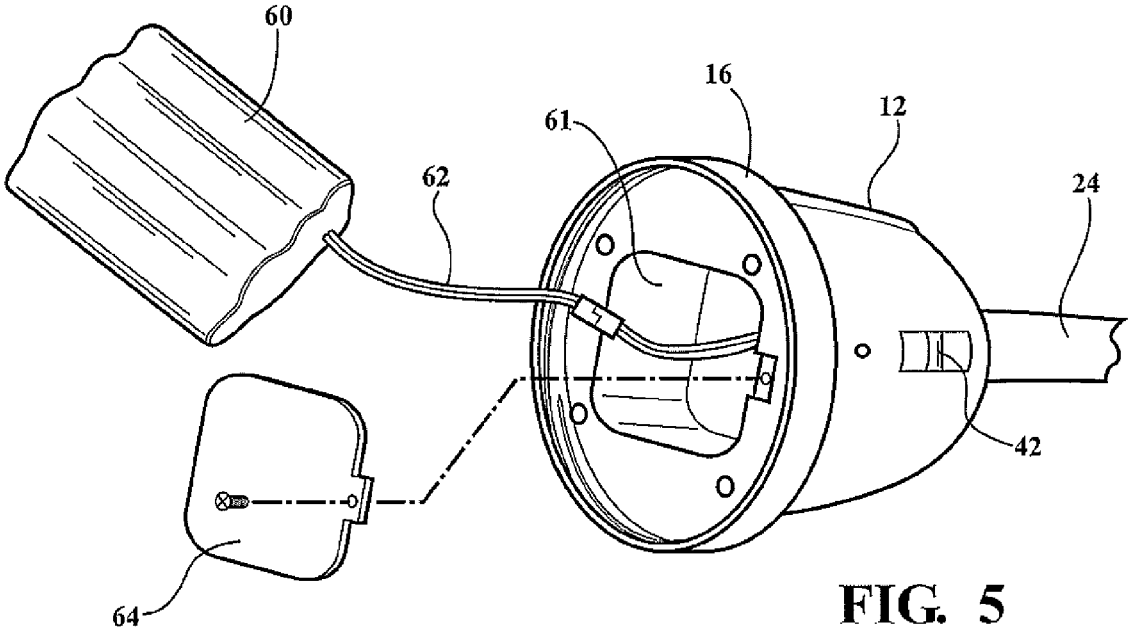
FIG. 5 is an exploded view of the upper base portion of the embodiment of FIG. 1 showing how a rechargeable battery is mounted into the upper base portion and wired for connection to the motor in the ball-shaped motor housing.

Referring first to FIGS. 1-5, there is shown a reconfigurable, rechargeable battery-powered personal fan 10 designed for multiple uses including use by golfers riding in a golf cart 11 having cup holders. The reconfigurable fan 10 comprises a two-part base including a molded high-impact plastic upper base 12 and a hollow lower base 14. The upper base 12 is defined by a shell which tapers upwardly into a curved neck 24 and a lower, larger diameter bezel portion 16 defining a top shoulder 17. As shown in FIGS. 3 and 5, the bezel 16 of the upper base portion 12 is equipped with interior threads 22 complemental to the exterior threads 19 on the collar of a lower base 14. The collar is located just above a bezel 18 which is of the same diameter as the bezel 16 so as to form a continuous external band-like feature when the base portions 12 and 14 are attached. Lower base 14 is tapered and sized to fit into a cup holder as shown in FIG. 1, the bottom of bezel 18 providing a bottom shoulder that can stabilize the fan in a cup holder.

The curved neck 24 is made separately from the base 12, is hollow and molded of plastic to receive wiring as hereinafter explained. The neck supports a ball-shaped upper motor housing 26 made in two pieces to receive and hold a brushless ball bearing DC motor 32 having an output shaft 34 oriented at an angle to the neck 24. The motor housing 26 has, attached to the lower portion thereof, a bracket 28 which is connected by means of a bolt and wing nut assembly 30 to the neck 24 to allow the angle of the motor housing 26 and the lightweight, small diameter, two-blade impeller 36 which is attached to the motor shaft to be angularly reoriented according to the location, size and desires of the person or persons using the fan. The impeller 36 is equipped with two lightweight molded plastic blades integral with a hub 37 and having wingless 38 at the outer edges thereof to enhance air flow volume. The diameter of the impeller is between about 6 to 8 inches and it operates at high speed and with high efficiency. A molded plastic cage 40 may be suitably attached to the motor housing 26 to protect the user against inadvertent contact with the blades of the impeller 36 when rotating. The impeller runs at about 5000 RPM for about 4 hours at full speed and for about 6.5 hours on low speed; e.g., about 3000 RPM. The overall height of the fan is about 19 inches with base 14 attached.

As shown in FIGS. 2 and 5, the upper base portion 12 is provided with an interior molding defining a cavity 61 to receive a rechargeable lithium ion battery 60 connected by wiring 62 to the motor 32 through a switch 42 which provides both an on/off function as well as selection of both high and low speeds. A conventional AC to DC charger having a plug-type fitting (not shown) can be provided to charge the battery 60 through a charge port 46. A retainer plate 64 holds the battery 60 in place within the cavity 61 in the upper base portion 12.

FIG. 2 shows one configuration; i.e., a generally tapered configuration for the hollow lower base 14. This is designed to fit in the cup holders of E-Z-Go TXT and E-Z-Go RXV golf carts. As shown in FIG. 3, an alternative lower base 50 of stepped design is provided with a bezel 51 identical to the bezel 18 and threads 54 identical to the exterior threads 20 on the collar of the base portion are provided so that the alternative hollow lower base can be threaded onto the upper base 12. The alternative lower base 50 is provided with a stepped/tapered configuration to match the cup holder configurations found in a Club Car Precedent and Club Car DS golf cart cup holders. A flexible elastomeric adapter ring 58 is provided for attachment to the lower hollow base portion 50 to adapt that base portion to a Yamaha golf cart cup holder. Another similar polymer ring 48 can be used in combination with the first lower base portion 14 as desired. These retainer rings 48, 58 can easily be squeezed together and stored in the hollow base portions 14, 50 for convenience. Each base 14, 50 is molded with an enlarged diameter bezel 18, 51 to match the diameter of the bezel 16. Altogether, the overall combination shown in FIG. 3 can be sold as a kit in order that the fan 10 can be used in virtually any of the popular golf carts on the market at this time. Alternatively, the lower base 14 may be removed and the fan 10 placed on a desk or table.

Turning now to FIGS. 6 and 8 through 13, a second embodiment of the invention will be described. In this embodiment, the fan 66 is also provided with a two-part molded high impact plastic base including an upper base portion 67 having a larger diameter bezel 68 and a lower base portion 72 of cylindrical configuration but having a larger diameter bezel portion 74 which matches the diameter of bezel 68 and is threadedly joinable to the upper base portion 67 by means of threads 76, 77 adapted to work complementally with one another on the lower and upper base portions respectively. In short, the hollow cylindrical lower base portion 72 can be threadedly attached to the upper base portion 62 by means of the size matched bezels 64, 74 and the threaded connection provided therefor.

Figure 6:
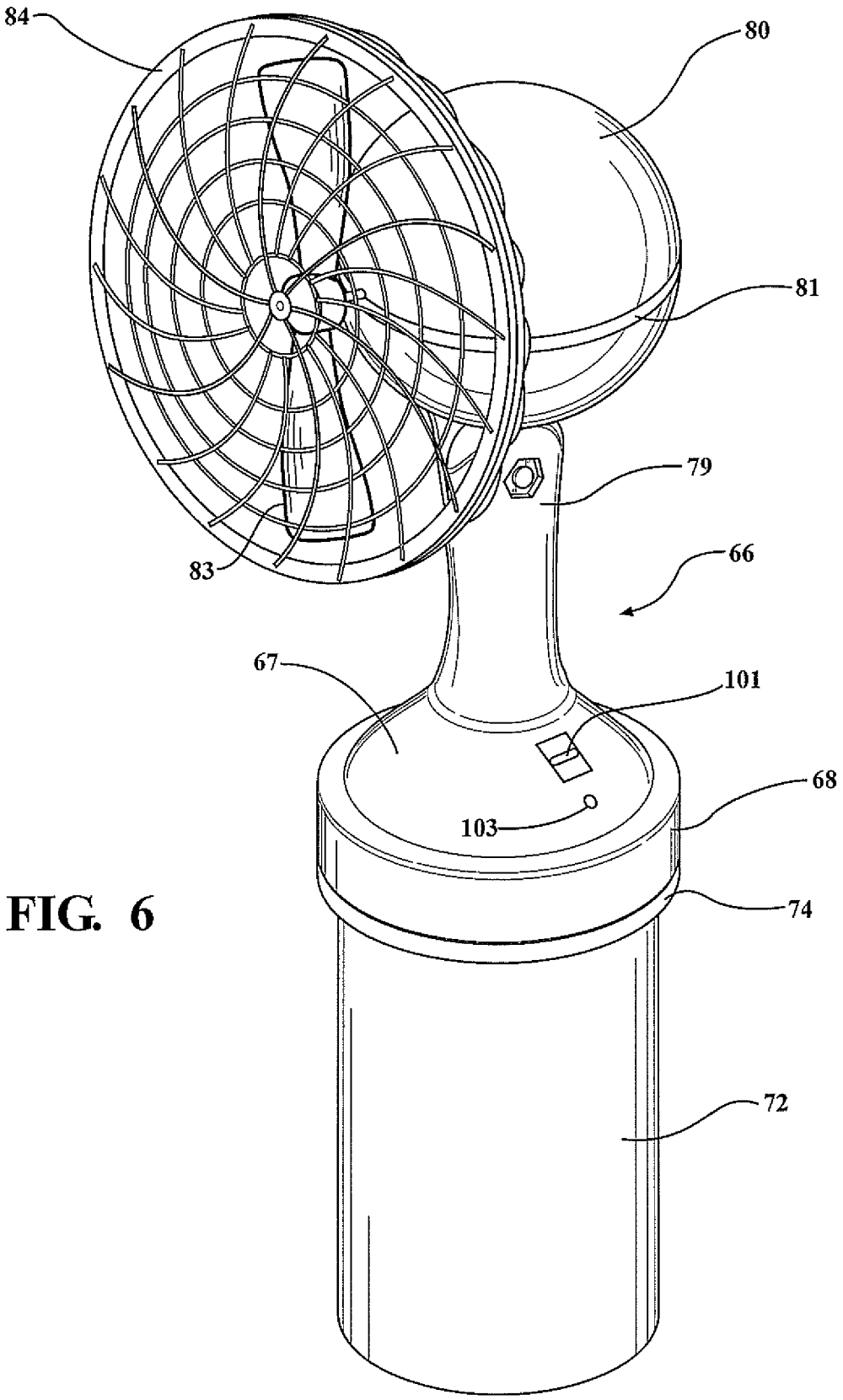
FIG. 6 is a perspective view of a second embodiment of my invention showing a canister style lower base portion.

The upper base portion 67 tapers into an axially centered, vertical elongate neck 79 which is pivotally and adjustably attached to a three-piece ball-shaped motor housing 80 containing a DC motor 32 with an output shaft connected to a two-blade impeller 83 substantially identical to the impeller 36 associated with the embodiment of FIGS. 1 and 2. Motor housing 80 includes an upper hemisphere, a lower hemisphere with a molded-in motor cradle 151 and a red equatorial ring 81 between the hemispheres for aesthetic appeal and ease of assembly. The three parts may be joined by any conventional means but a snap-together assembly is preferred. Again, the impeller blades are caged by a molded plastic shroud or cage 84 for protection. A speed control switch 101 and a charging port 113 are provided on the upper base portion as shown in FIG. 6. Speeds are on the same order as those in the embodiment of FIG. 1.

Figure 8:
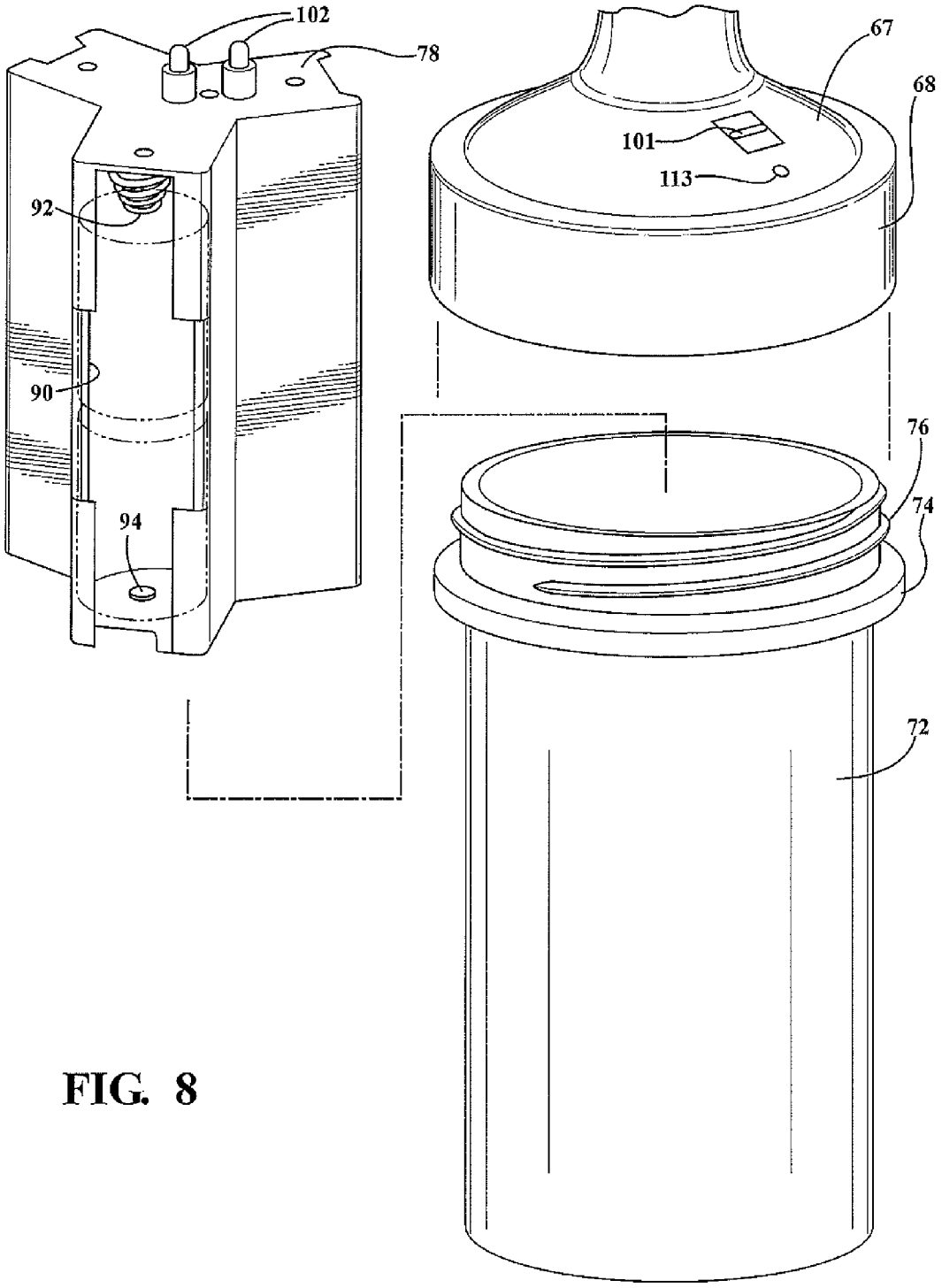
FIG. 8 is a perspective view of the base of the second embodiment of the invention opened up to receive a D-cell battery cartridge having the capacity to receive stacks of D-cell batteries.
Figure 9:
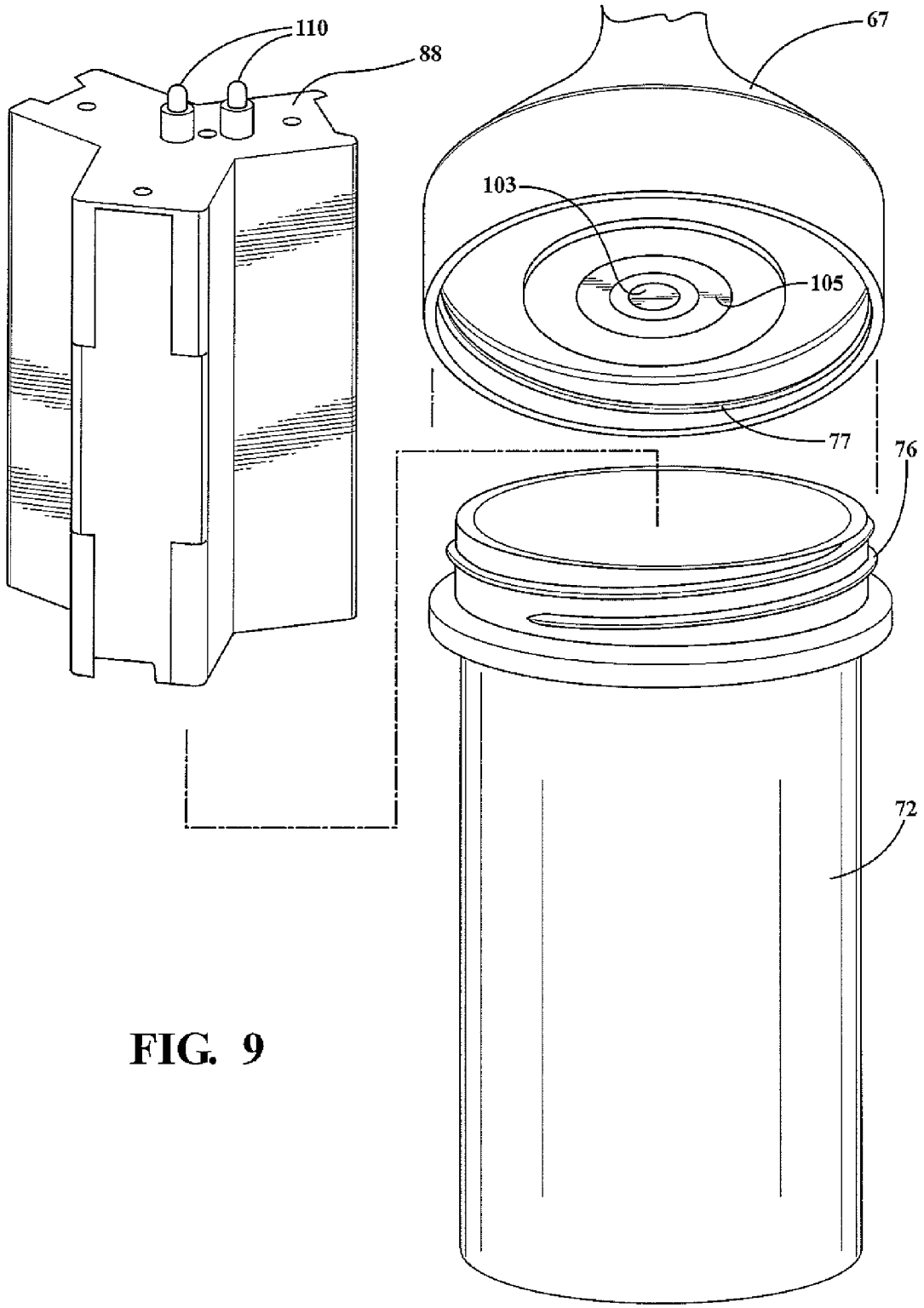
FIG. 9 is a perspective view of the base of the alternative embodiment showing a rechargeable battery pack as well as the configuration of contact rings on the interior of the bezel portion of the upper base.

In this case, a purpose of the hollow lower cylindrical base portion is to act as a canister 72 for one or the other of two battery cartridges 78, 88 shown in FIGS. 8 and 9, respectively. The battery cartridge 78 shown in FIG. 8 is a molded plastic article having three parallel vertical slots 90 each of which can hold two serially arranged D-cells. Contacts 92, 94 are provided on opposite ends of each slot to make an electrical circuit through the switch 101 and to the motor in the ball-shaped upper motor housing 80 in the manner described with reference to FIGS. 4 and 5. Spring contacts 102 are provided on the top of the cartridge 78 to make contact with conductive plates 103 and 105 on the interior of the upper base portion 67 within the bezel as best shown in FIG. 9 to extend the battery circuit through the switch 101 into the motor in the upper housing.

FIG. 9 shows the battery cartridge 88 as a permanent rechargeable battery having essentially the same configuration as the cartridge 78 of FIG. 8; i.e., it fits snugly within the lower base canister 72 and is provided with spring contacts 110 on the upper surface which make contact with the plates 103 and 105 in the upper base portion 67 just as the contacts 102 operate in connection with the same components in the embodiment of FIG. 8.

The drop-in battery cartridges 78, 88 of the embodiments shown in FIGS. 8 and 9 have a distinct advantage when the fan 66 is used in a golf course environment, whether private or public. Specifically, the fan 66 may be provided on a golf cart using the holder arrangement shown in FIG. 10 as an extra cost option when a person rents or otherwise retains a golf cart for use in playing a round of golf. Cartridge housing 72 is too large for a conventional cup holder, so a larger diameter receptacle is mounted elsewhere on the cart. When the cart is returned after a round is completed, the attendants who are normally responsible for unloading, washing and recharging and/or refueling the golf cart, can quickly open the canister 72 by unscrewing it from the upper base portion 67, pulling out the discharged or partly-discharged battery pack and replacing it with a freshly charged battery pack or cartridge, ready for the next user of the cart. The batteries of the discharged or partly discharged cartridge can then be recharged to be ready to drop back into the lower base canister for the next customer. In this fashion, a single fan with two battery cartridges can service a single cart for continuous use over a full day of operation involving multiple rentals.

Figure 10:
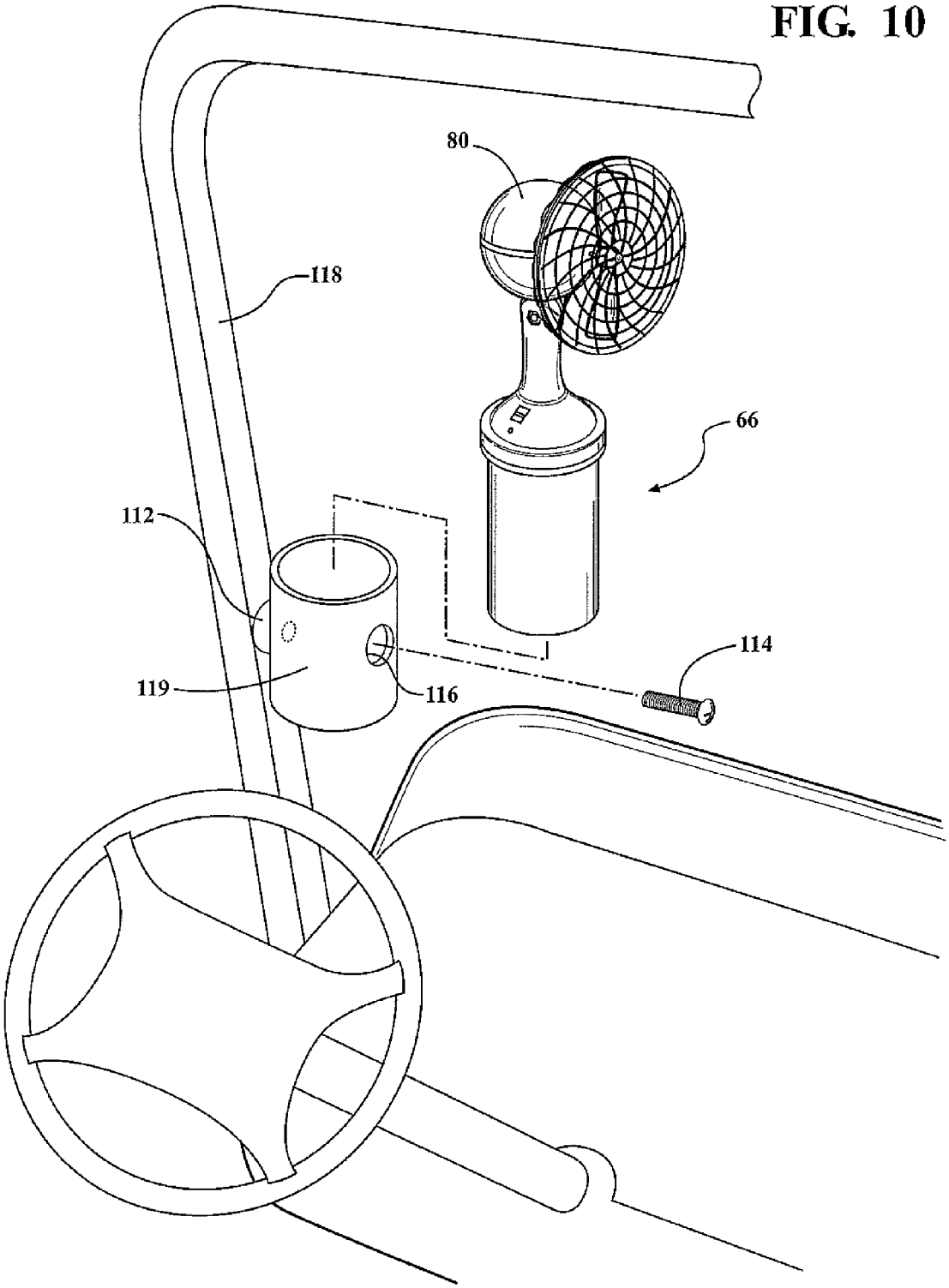
FIG. 10 is a perspective view showing how the battery cartridge embodiment may be used in combination with a golf cart having a windshield rail.

FIG. 10 shows just one way in which a fan 66 may be supported on a golf cart. In this case, a special cylindrical receptacle 119 is provided with a radial appendage 112 which receives in a through-bore a threaded stud 114 by way of an access hole 116 so that a hole may be drilled and tapped into the windshield rail 118 of the golf cart to receive the stud 114 to secure the receptacle 119 in place. The fan 66 may then be dropped into the receptacle and/or removed therefrom depending on whether or not the renter of the golf cart wishes to have the optional fan during a round.

Figure 7:
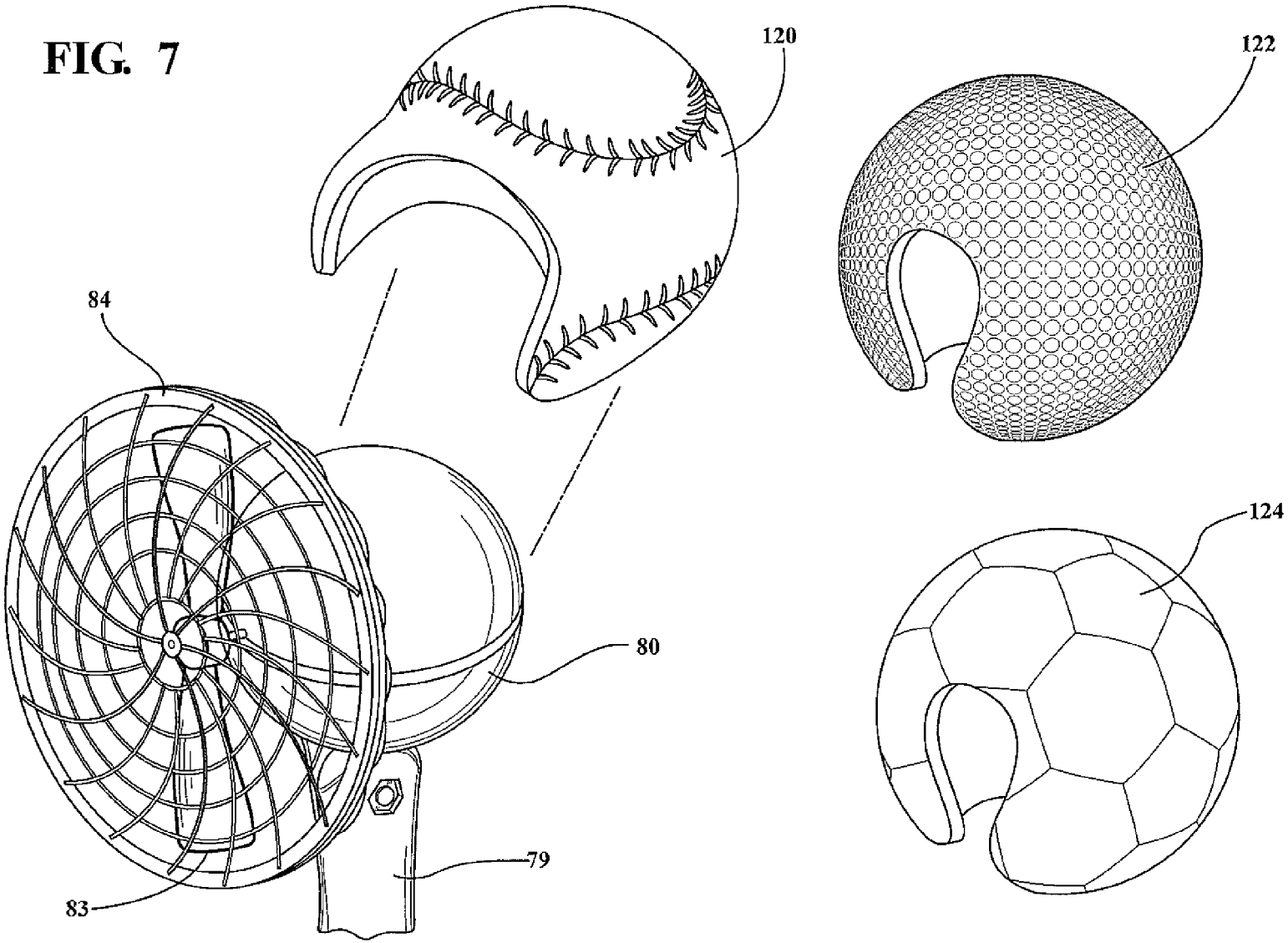
FIG. 7 is a perspective view of the top portion of the fan illustrating three representative ornamental aesthetic elastomeric coverings which can be added to the ball-shaped motor housing to link the fan thematically to a particular sport, such as baseball, golf or soccer.
Figure 11:
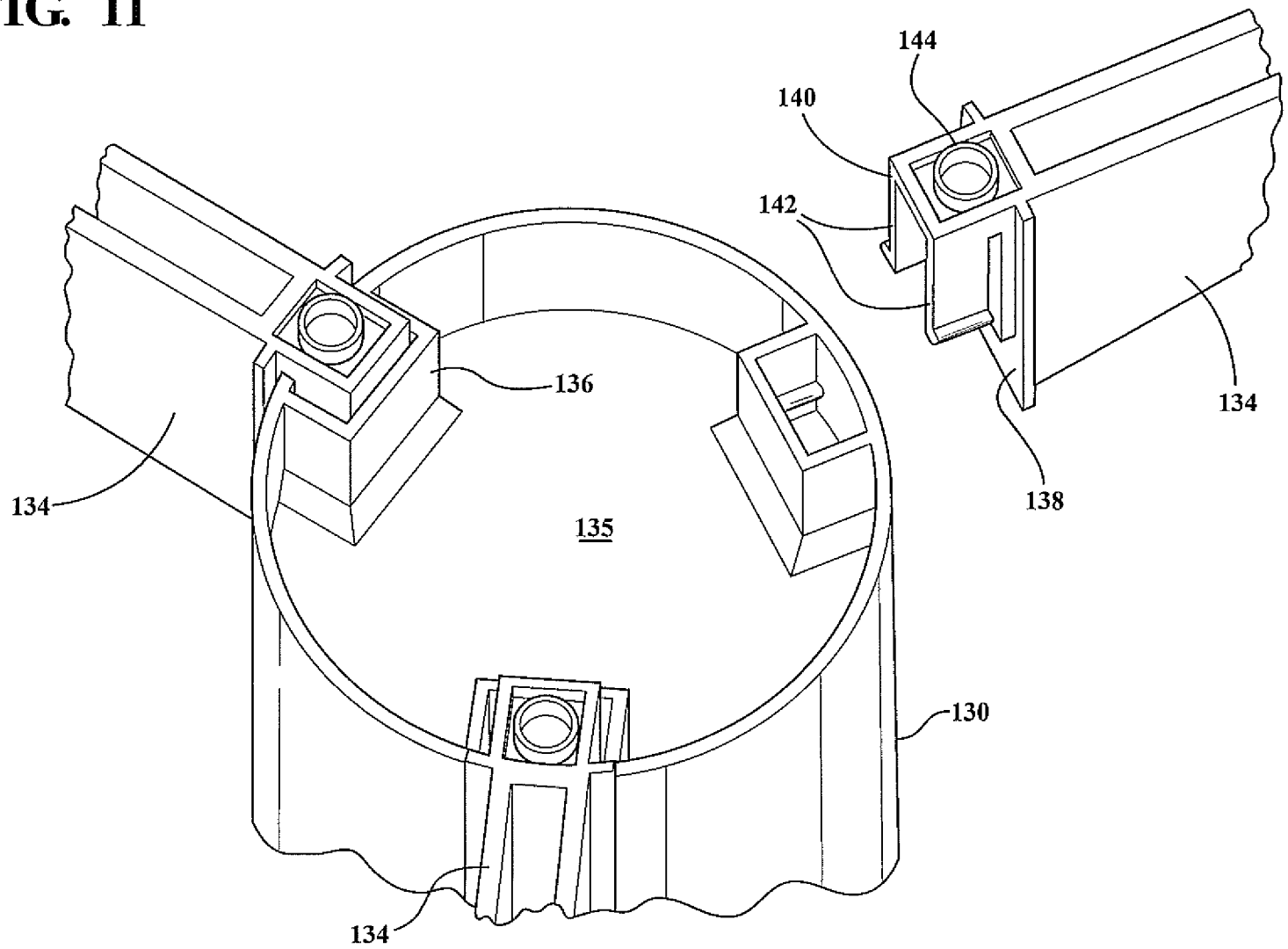
FIG. 11 is a perspective view of the bottom of an alternative lower base portion showing how a tripod arrangement of legs can be added to the device.

FIGS. 7 and 11 show further accessories for tailoring a fan to a specific activity and/or purpose. Looking first to FIG. 7, the fan may be provided with one or a set of elastic slip-on glove-like covers 120, 122, 124 which are designed and manufactured to have the appearance of objects, in this case balls, associated with individual sports. By way of example, cover 120 matches with the ball-shaped motor housing 80 to represent a baseball while cover 122 represents a golf ball and cover 124 represents a soccer ball. Other types of sport balls can also be designed.

Figure 12:
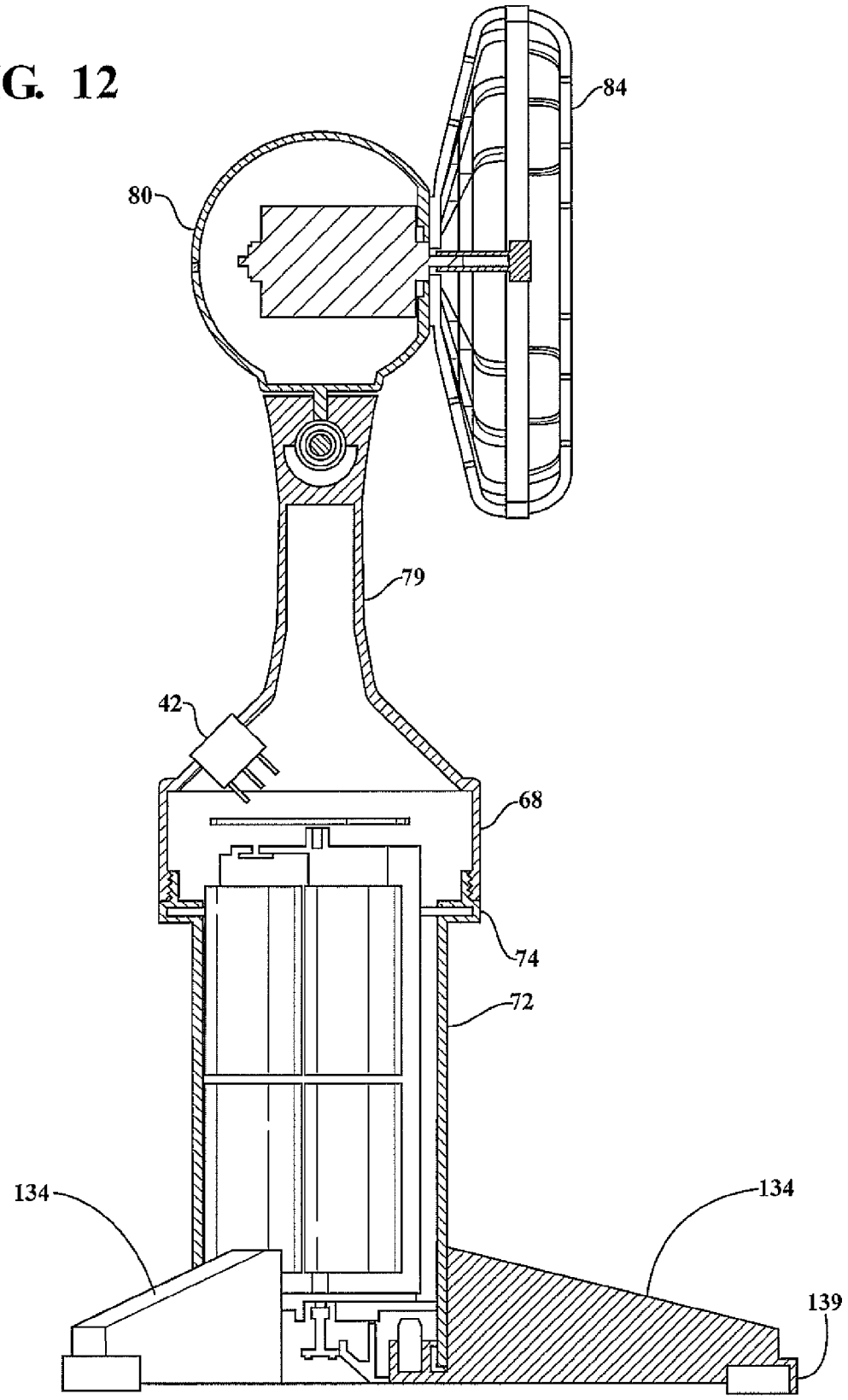
FIG. 12 is a side view, partly in section, of the alternative embodiment with legs attached.
Figure 13:
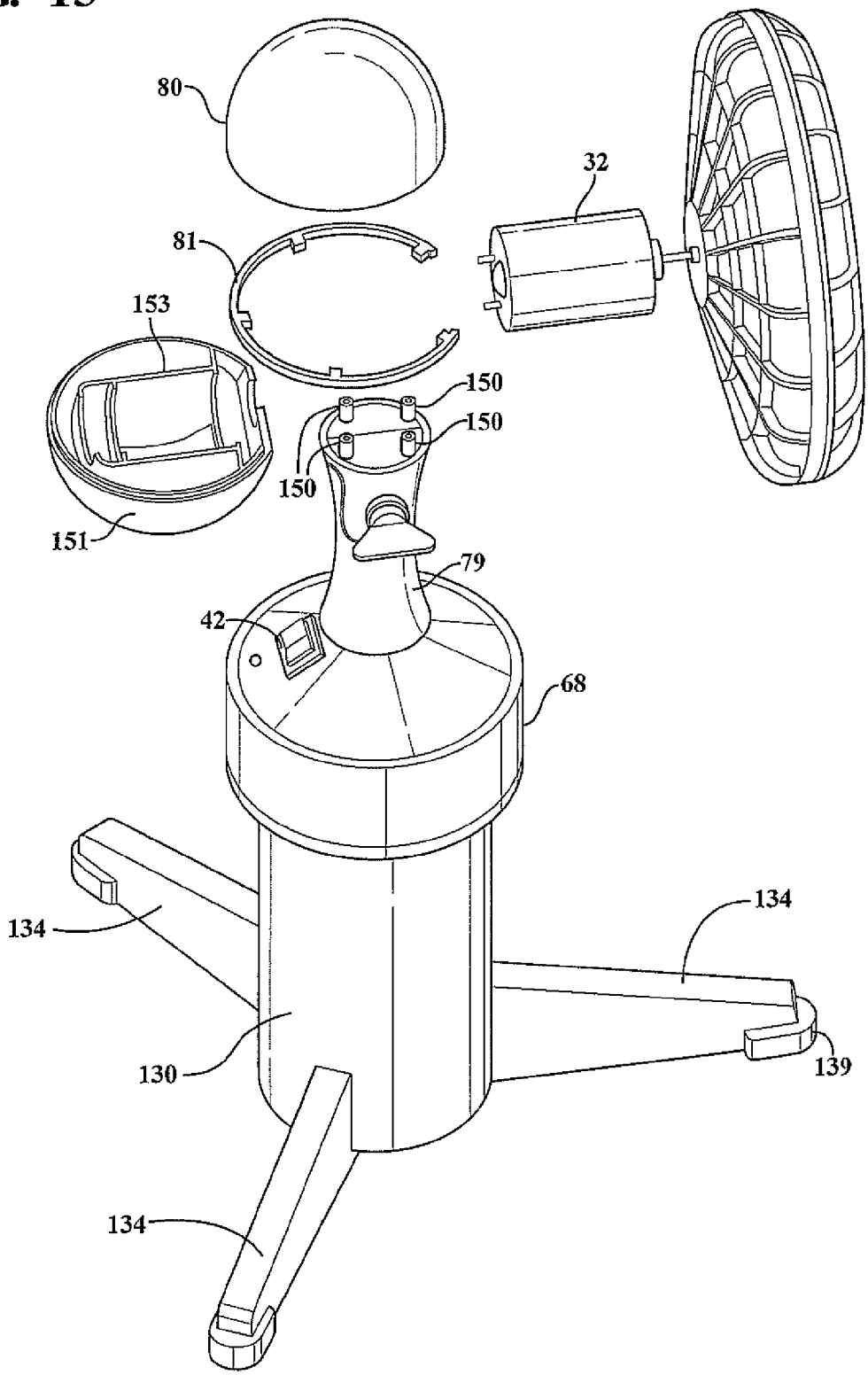
FIG. 13 is a perspective view of the alternative embodiment with the motor housing exploded to show mounting detail.

FIGS. 11-13 show a modified lower base canister 130 design to receive a set of three molded plastic legs 134 in a tripod arrangement for additional support. The base canister 130 has a recessed bottom 135 defining a cylindrical sidewall. Within the recess, spaced 60° apart, are three rectangular receivers 136 integral with the canister sidewall. Each leg 134 tapers outwardly to a molded foot 139. The legs are hollowed out to conserve material and make them light in weight. At the larger end, each leg has a curved end wall 138 that rests against the outer cylindrical surface of the canister 130 when the leg is installed in a receiver 136. Adjacent the end wall 138 is a snap-on fitting 140 with two spring fingers 142 that can be squeezed together to fit into a receiver 136. Ribs on the inside of the receiver walls releasably hold the spring fingers 142 in during use, but allow them to be easily pulled out. Space between the fingers 142 and the sidewall 138 accommodates the sidewall of the canister. A leveler ring 144 is molded into the bottom of fitting 140 to contact a support surface such as a desk top or table. This 3-point contact system assures that the fan does not wobble or rock when resting on a level support surface. Curved ends on the spring finger 142 allow the legs 134 to be easily removed.

FIGS. 12 and 13 show details of construction with the legs 134 attached to the canister 72 and the upper base 79 screwed on. The top of neck 79 is provided with four screw posts 150 to allow for attachment of the bottom 151 of the ball-shaped motor housing to the pivot at the top of the neck 79. A decorative ring 81 of contrasting color fits between the bottom 151 and top 80 to complete the ball after the motor 32 is installed. A snap-together assembly is preferred using detents in mating annular surfaces.

What is claimed is:

1. A high-volume output, battery powered portable fan comprising:

a molded plastic base having a vertical axis of symmetry and including a first large diameter portion defining an interior volume bounded on a lower end by a flat bottom to enable the fan to stand unsupported on a table or the like and, on the upper end, by an upwardly narrower neck;

a battery system mounted wholly within the interior volume;

a ball shaped motor housing attached to the neck and containing a high speed DC ball bearing motor having a drive shaft extending outwardly and forwardly of the housing at an angle to the vertical axis, a manually adjustable pivot link attaching said ball shaped housing to the neck so as to permit changes in the pitch angle of the drive shaft;

a light weight two-blade plastic impeller attached to said shaft;

each impeller blade extending radially outwardly along a diameter common the other blade and having integrally formed winglets, said blades being attached to each other only through a hub;

a switch on said base for turning the fan on to selectively turn said impeller blades at a maximum speed of about 5000 RPM thereby to produce a high output air volume; and a plastic shroud surrounding the impeller and attached to the motor housing;

said shroud having a cage design including a series of concentric rings of different diameters and radial spokes attaching said rings to one another; and said fan further comprising a screw-on adapter base attachable to said plastic base with threads internally of said plastic base to enable said fan to be mounted within a conventional cup holder.

2. A multi-use battery powered portable fan as defined in claim 1 wherein the battery system comprises in principal part a rechargeable battery permanently installed in the first base portion, said base portion being further provided with a charging port electrically connected to the battery for charging same.

3. A battery powered portable fan as defined in claim 1 further comprising an elastomeric flexible ornamental cover stretchably attachable to and over said ball-shaped motor housing to create the appearance of a sport article.

* * * * *